US005419436A

United States Patent [19]

Powell

[11] Patent Number: 5,419,436

[45] Date of Patent: May 30, 1995

[54] CUP WITH ARTICLE RECEIVING AREA ON BOTTOM SURFACE

[75] Inventor: David A. Powell, Coon Rapids, Minn.

[73] Assignee: Kablooe Products, Inc., Blaine, Minn.

[21] Appl. No.: 173,085

[22] Filed: Dec. 27, 1993

[51] Int. Cl.[6] ..... B65D 1/22

[52] U.S. Cl. ..... 206/519; 206/217; 220/504

[58] Field of Search ..... 220/503, 504, 505; 206/217, 519

[56] References Cited

U.S. PATENT DOCUMENTS

| | | | |
|---|---|---|---|
| 2,971,304 | 2/1961 | O'Neil | 206/217 |
| 3,263,803 | 8/1966 | Almond | 220/504 |
| 3,741,383 | 6/1973 | Wittner | 220/504 |
| 4,096,947 | 6/1978 | Morse | 206/217 |
| 4,231,476 | 11/1980 | Compton et al. | 206/217 |
| 4,416,370 | 11/1983 | Beall | 220/504 |
| 4,600,111 | 7/1986 | Brown | 220/504 |
| 4,832,202 | 5/1989 | Newman et al. | 206/217 |
| 4,923,702 | 5/1990 | Powell et al. | 206/217 |

FOREIGN PATENT DOCUMENTS

| | | | |
|---|---|---|---|
| 3823567 | 7/1989 | Germany | 220/504 |

*Primary Examiner*—Joseph Man-Fu Moy
*Attorney, Agent, or Firm*—J. R. Cwayna

[57] ABSTRACT

A molded cup having an upwardly directed article receiving area on the bottom surface thereof to receive an article therein with a cover provided over such area to normally retain the article. The cover provides the primary retention for the article and the cover is openable or removeable from the cup for access to the article. The cup is normally self supporting to remain in upright position after removal of the cover to allow its continued use as a cup. The cover is transparent to allow a person to ascertain the contents being retained. A stop arrangement is provided to prevent one cup from possibly damaging or breaking the cover on the bottom of a nested cup.

17 Claims, 2 Drawing Sheets

FIG. 1
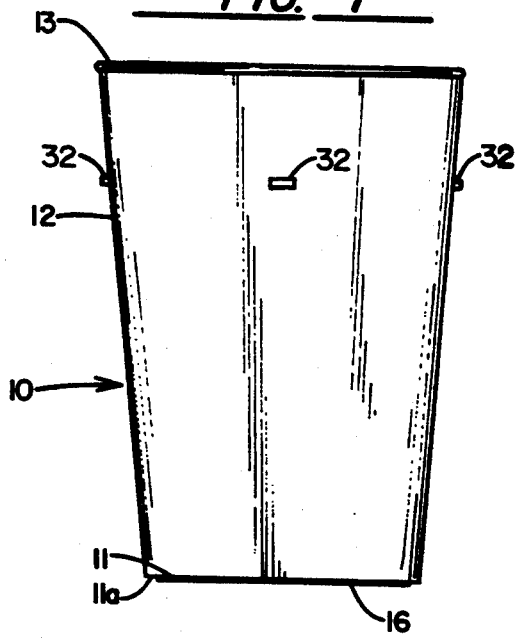
FIG. 2
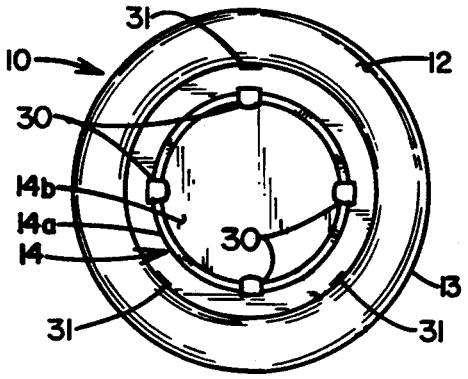
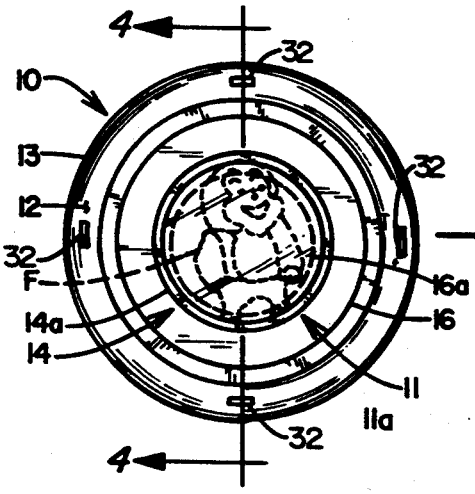
FIG. 3
FIG. 5
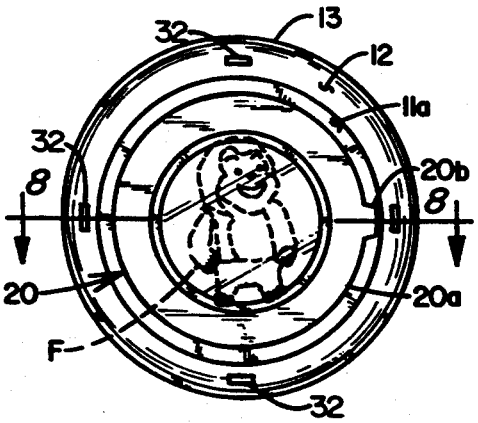

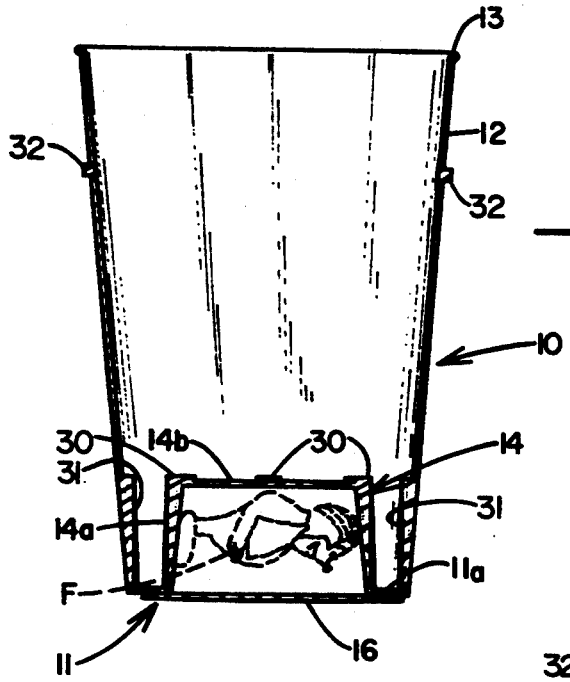
FIG. 4
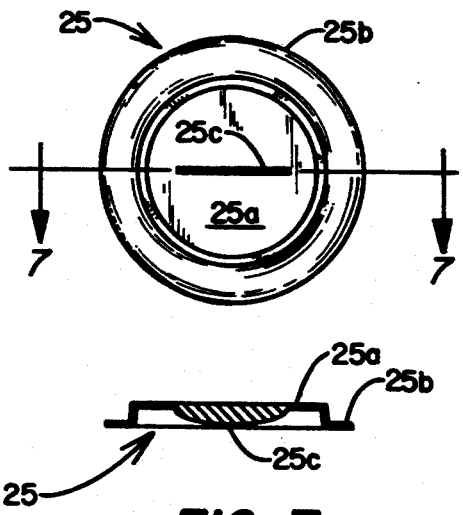
FIG. 6
FIG. 7
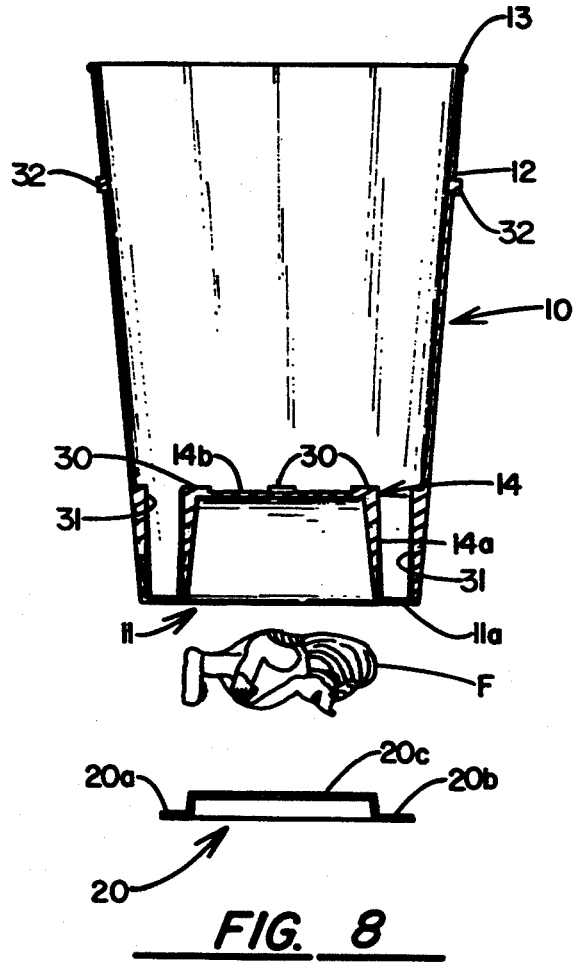
FIG. 8

CUP WITH ARTICLE RECEIVING AREA ON BOTTOM SURFACE

RELATED APPLICATIONS

Applicant has filed an application for Patent, entitled CONTAINER WITH INSERT AREA, Ser. No. 08/068,421, filed May 28, 1993 which discloses a container having an article receiving insert area on the sidewall with a film covering the area to removeably retain an article. In such application, the container is disclosed as a bottle.

FEDERAL SPONSORSHIP

This invention is not made under any Federally sponsored research or development program nor under any other independently sponsored program.

FIELD OF THE INVENTION

This invention relates generally to the art of containers and more specifically to cups or beverage containers which are provided with an inwardly directed area on the bottom surface thereof for placement of and temporary retention of an article therein with the retention of the article provided by a cover which will allow viewing of and removal of the article without damaging the cup.

SHORT SUMMARY OF THE INVENTION

A container, more specifically a cup or similar unit having an upwardly arranged sidewall and a bottom surface with a portion of the bottom surface being concavely or frusto-conically inwardly formed to provide an article retention area.

After placement of an article into the retention area, a cover is placed thereover and adhered or otherwise connected to the bottom surface. The cover may be in the form of a film material adhered to the bottom surface of the cup or may be a removable lid covering such area. The purpose of the cover is to temporarily retain the article and allow viewing and, finally, removal of the article. For removal of the article, the film may be cut or the cover removed.

The bottom surface is so designed that the remaining portion surrounding the formed portion will provide sufficient support to the cup to allow its continued function as a beverage container.

A stop is provided on the cup to prevent damage to the cover material of a nested cup.

The article for which the area is designed is not essential to the use of the container and is normally unrelated thereto except as the same may be advertised or promoted through sales material which could include advertising on the sidewall of the cup.

BACKGROUND AND OBJECTS OF THE INVENTION

Premium articles sold in conjunction with other products often provide sufficient incentive to purchase a product. This is often the case when a motion picture provides a basis for producing and selling figurines of animals or characters shown in the film and children are anxious to obtain one or several of such toy figures and they are not sold through normal retail outlets but rather are only sold in conjunction with another product. With the employment of the teachings of this application, a beverage cup or the like is provided as a carrier for the character and in order to obtain the character, the beverage and cup is purchased.

Applicant's concept provides this saleable combination, allows the purchaser to select the premium character he or she wishes and the removability of the retaining means does not affect further use of the cup. In addition, the entire sidewall of the cup is available for advertising uses and the location of the premium receptacle makes the completed manufacture of the unit very straight forward.

None of the prior art provides bottom surface useage. Obviously, in use, the cup with the desired premium would be selected and thereafter, the cup filled. Many times, the purchaser does not know what premium is being provided and the child is upset with never having obtained the one necessary to complete a set or the one he or she wants. Such frustration is eliminated with the applicant's concept.

It is therefore an object of the applicant's invention to provide a cup, beverage container or the like which is provided with an upwardly directed article receiving area on the lower surface thereof to accomodate an article placed therein with cover means to retain the article.

It is further object of the applicant's invention to provide a cup, beverage container or the like which is provided with an upwardly directed article receiving area on the lower surface thereof to accomodate an article placed therein with covering, article retention means which are destructable or removeable to allow access to the article without destroying the container.

It is still a further object of the applicant's invention to provide a cup, beverage container or the like which is provided with an upwardly directed article receiving area on the lower surface thereof to accomodate an article placed therein with covering, article retention means which allow viewing of the article.

These and other objects and advantages of the applicant's invention will more fully appear from a consideration of the following drawings and accompanying description.

DESCRIPTION OF THE DRAWINGS

FIG. 1 is a side elevation of an illustrative cup or beverage container embodying the concepts of the applicant's invention:

FIG. 2 is top plan view thereof;

FIG. 3 is a first bottom view thereof illustrating one form of article retention means covering the bottom surface of the cup;

FIG. 4 is a vertical section taken substantially along Line 4—4 of FIG. 3;

FIG. 5 is a second bottom view thereof illustrating a second form of article retention means;

FIG. 6 is a third bottom view illustrating a third form of article retention means;

FIG. 7 is a section taken substantially along Line 7—7 of FIG. 6; and, FIG. 8 is an exploded view of a cup, article that would be retained and the retention means as illustrated in FIG. 5.

DESCRIPTION OF THE INVENTION

As illustrated in the accompanying drawings, applicant's cup is generally designated 10 and as such includes a bottom 11 and an upwardly and outwardly directed side wall 12 contiguous to the bottom 11 and terminating at an upper edge 13. As illustrated in the cross section of FIG. 4, the upper edge 13 may be rounded for drinking convenience as well as for seating of a cover (not shown) thereon. As also illustrated in FIG. 4, the bottom surface 11 is provided with an inwardly and upwardly directed, frusto-conical, article receiving area 14. Being frusto-conical in shape, this area 14 includes an inwardly and upwardly directed sidewall 14*a* and a top 14*b*. It should be noted, as shown in FIG. 4, that this area 14 is located generally centrally of bottom 11 such that a flat, ring support area 11*a* exists between the sidewall 12 and such retention area 14.

As the cup 10 is formed through various molding techniques, the angularity of the sidewall 12 and the angularity of sidewall 14*a* of the retention area provides for ease of molding with necessary draft.

The article to be retained and sold in conjunction with the cup 10 is designated F to denote a figurine but it should be obvious that any article could be provided.

Several different structures for retaining the article F within area 14 are illustrated.

A first and possibly simplest article retention structure is provided in FIGS. 1, 3 and 4 wherein a film 16 covers area 14 and is adhered to the flat portion 11*a* of bottom 11. Film 16 is transparent to allow viewing of the article F and is easily perforated to allow access to the article F. A cut or break line 16*a* may be provided on the film 16. Similarly, if this film is attached with a reusable type adherent, the film 16 may be completely removed for use of article F, the article replaced and the film thereafter replaced.

A second form of article retention structure is provided in FIGS. 5 and 8. As illustrated therein, a frusto-conical cover or cap 20 is provided with a radially extending flat portion 20*b* surrounding the frusto-conical portion 20*c* thereof with a lift tab 20*a* extending radially therefrom. Obviously, the frusto-conical portion 20*c* is provided to be received interiorally of the frusto-conical article receiving section 14 and is normally held therein by friction or may additionally be held therein by an adhesive. This type of cover member would be easily reused. Again, this member 20 would allow viewing of the retained article F.

A third form of article retention structure is provided in FIGS. 6 and 7. In these views, the cover member is designated 25 and includes a frusto-conical section 25*a* surrounded by a flat, radially extending portion 25*b*. As illustrated, a relatively thin, finger grasping section 25*c* extending from the flat portion of such section 25*a* is provided. The height of such section 25*c* would be such that it does not extend beyond the flat bottom surface 11*a* of the cup bottom 11. Again, this structure could be adhered or frictionally held within the frusto-conical, article holding section 14 of the cup 10.

In transport, strorage and the like, cups are normally nested and when so nested, applicant has found it beneficial to provide stops on select portions of the cups so that the bottom of one cup having the plastic covering 16 or either or any of the covers 20, 25 will not be damaged so as to possibly dislodge the contained article F. Although many forms of stop devices could be provided, applicant illustrates three obvious forms in the various views and particularly the cross sections of FIGS. 4 and 8.

In a first form, four stops 30 are provided in spaced relation about the formed frusto-conical area 14. These stops 30, as illustrated may begin at the lowest portion of the conical area 14 and extend vertically upwardly therefrom to a height slightly above the top 14*b* of such area. Notably, such a radially extending strut would provide an upper support surface to the bottom of the next above, nested cup and would abut the bottom 11*a* thereof with no danger of impinging upon the various closures on such nested cup. Obviously, if the film covering were utilized, the possibility of damage thereto would be greater than if one of the other covers, which would, assumably, be more rigid were used.

In a second form of stop, three such upwardly directed elements 31 are provided on the interior surface of the cup and, in the form shown, extend upuwardly from the bottom 11*a* of the cup to a point above the level of the frusto-conical area 14.

In a third form of stop, a ring, or a plurality of stop elements 32 are formed on the exterior surface 12 of the cup. Such a ring or indiviual stops 32 would abut with the uppermost edge 13 of the next downward cup and prevent cover impingement and damage.

It should be obvious that the all forms of the stops could be total ring sections or individual stop elements without departing from the scope of the invention or the intended generic utilization thereof.

The applicant has disclosed the article receiving area 14 to be frusto-conical in shape and similarly has described the cup as having a taper. These particular shapes should not be considered as limiting as various cups are not provided with a taper or slanted sidewall and the article receiving area could be straight sided or could simply be concavely formed.

The use of the applicant's container should be obvious. Obviously, a cup has been described and beverages are most often associated with cups. The unit is really a container and as such could be filled with popcorn or any other suitable commodity with the primary aspect of the invention being to provide a container which also provides dual function of temporarily retaining an article.

What is claimed is:

1. A container having an article receiving area formed on the bottom surface thereof, including:
   a. a generally flat bottom portion;
   b. at least one generally upright sidewall contiguous with said bottom and extending generally vertically upwardly therefrom;
   c. an article receiving, upwardly directed area of a predetermined height provided on said bottom surface;
   d. cover means positionable with respect to said article receiving area to removeably retain an article therein; and,
   e. upwardly directed stop means spaced from said bottom at least equal to said predetermined height of said article receiving area, whereby a nested container will be supported thereby.

2. The container as set forth in claim 1 and said article receiving area being arranged generally centrally of said bottom providing a generally flat area therearound to normally support the container.

3. The container as set forth in claim 1 and said article receiving area being generally frusto-conical in shape.

4. The container as set forth in claim 1 and said article receiving area being concavely formed in said bottom.

5. The container as set forth in claim 1 and said cover means including a film material covering said article receiving area and being adhered to said bottom around said article receiving area.

6. The container as set forth in claim 5 and said film material allowing viewing therethrough.

7. The container as set forth in claim 5 and said cover means having a break line to allow access to an article contained in said article receiving area.

8. The container as set forth in claim 1 and said cover means including a cover element arranged and constructed to be partially received into said article receiving area and held therein by friction.

9. The container as set forth in claim 8 and grasping means provided on a portion of said cover element for removal thereof.

10. The container as set forth in claim 9 and said grasping means including a lifting tab.

11. The container as set forth in claim 1 and stop means arranged interior of the cup preventing total nesting of one cup within another cup whereby said cover means are not contacted by a receiving cup when so nested.

12. The container as set forth in claim 1 and stop means arranged exteriorally of the cup preventing total nesting of one cup within another cup whereby said cover means are not contacted by another receiving cup when so nested.

13. The container as set forth in claim 1 wherein said stop means is integral with said sidewall and extends radially inwardly therefrom.

14. The container as set forth in claim 13 and said stop means being formed in said sidewall and extending from said bottom surface of said container.

15. The container as set forth in claim 1 and said stop means being provided on the upper portion of said article receiving area.

16. The container as set forth in claim 1 and said stop means includes a plurality of spaced support members.

17. The container as set forth in claim 1 and said stop means being spaced from said bottom a distance greater than said predetermined height of said article receiving area.

* * * * *